US007467738B2

(12) United States Patent
Woods et al.

(10) Patent No.: US 7,467,738 B2
(45) Date of Patent: Dec. 23, 2008

(54) LOTTERY TICKET DISPENSER AND TICKET BIN

(75) Inventors: Curtis Woods, Centerville, OH (US); William E. Engelhardt, Jr., Morningview, KY (US)

(73) Assignee: Gtech Corporation, Providence, RI (US)

( * ) Notice: Subject to any disclaimer, the term of this patent is extended or adjusted under 35 U.S.C. 154(b) by 765 days.

(21) Appl. No.: 10/712,240

(22) Filed: Nov. 13, 2003

(65) Prior Publication Data

US 2005/0178810 A1 Aug. 18, 2005

(51) Int. Cl.
*B26F 3/00* (2006.01)

(52) U.S. Cl. ..... 225/93; 225/100; 225/103

(58) Field of Classification Search ..... 225/93, 225/100, 105, 104, 103; 211/208, 207, 206; 312/34.7, 34.8, 34.1, 330.1, 348.3, 348.5; 221/98, 96, 12, 13, 9, 92, 99, 104, 123, 124, 221/255, 256; 83/272; 463/16–18
See application file for complete search history.

(56) References Cited

U.S. PATENT DOCUMENTS

| | | | | | |
|---|---|---|---|---|---|
| 939,629 | A | * | 11/1909 | Balgie | 366/53 |
| 978,052 | A | * | 12/1910 | Oehring | 225/13 |
| 1,339,823 | A | * | 5/1920 | Harbaugh | 312/34.7 |
| 2,049,140 | A | * | 7/1936 | Schick | 312/122 |
| 2,229,911 | A | * | 1/1941 | Anderson | 312/131 |
| 2,518,320 | A | * | 8/1950 | Holman | 462/37 |
| 2,872,007 | A | * | 2/1959 | Robb et al. | 194/314 |
| 4,032,004 | A | * | 6/1977 | Coates | 206/39.6 |
| 4,105,270 | A | * | 8/1978 | Bergkamp et al. | 312/330.1 |
| 4,738,384 | A | * | 4/1988 | Tigner | 225/16 |
| 4,765,492 | A | * | 8/1988 | Howard et al. | 211/55 |
| 4,832,422 | A | * | 5/1989 | Fortmann | 312/330.1 |
| 4,834,470 | A | * | 5/1989 | Pinnow et al. | 312/311 |
| 4,836,113 | A | * | 6/1989 | Waddell et al. | 108/49 |
| 4,905,847 | A | * | 3/1990 | Hanson | 211/184 |
| 4,923,070 | A | * | 5/1990 | Jackle et al. | 211/59.2 |

(Continued)

FOREIGN PATENT DOCUMENTS

| | | |
|---|---|---|
| WO | 94/11164 | 5/1994 |

(Continued)

OTHER PUBLICATIONS

International Search Report, Appln. No. PCT/US04/36643, dated Mar. 16, 2005.

*Primary Examiner*—Boyer D. Ashley
*Assistant Examiner*—Omar Flores-Sánchez
(74) *Attorney, Agent, or Firm*—K & L Gates LLP

(57) ABSTRACT

A lottery ticket dispenser includes a number of ticket bins mounted in a housing of the dispenser. The ticket bins hold a fanfold stack of tickets proximate a transparent front panel of the dispenser for optimum visibility. The ticket bins are adjustably mounted in the dispenser for proper positioning in one of a variety of positions depending upon the size and configuration of the stack of fanfold tickets. The tickets are transported from the ticket stack upwardly over a guide by a ticket transport mechanism for processing by a powered separator to separate the adjacent tickets apart prior to dispensing. Excessive stress is not placed on the tickets which in prior art dispensers resulted in prematurely bursting the perforated joints apart or damaging the tickets.

35 Claims, 3 Drawing Sheets

U.S. PATENT DOCUMENTS 4,941,784 A * 7/1990 Flament ..... 410/121
5,016,946 A * 5/1991 Reznikov et al. ..... 312/108
5,026,129 A * 6/1991 Merl ..... 312/266
5,222,624 A * 6/1993 Burr ..... 221/1
5,238,128 A * 8/1993 Stoddard ..... 211/188
5,314,244 A * 5/1994 Swets et al. ..... 312/330.1
5,358,321 A * 10/1994 Leonardi ..... 312/9.55
5,399,005 A * 3/1995 Schafer ..... 312/107
5,462,349 A * 10/1995 Grabher ..... 312/348.1
5,492,398 A * 2/1996 Schafer ..... 312/34.7
5,542,552 A * 8/1996 Yablans et al. ..... 211/59.3
6,095,624 A * 8/2000 Wilbert ..... 312/34.7
6,230,926 B1 * 5/2001 Schafer et al. ..... 221/7
D448,956 S * 10/2001 Roberts et al. ..... D6/515
6,527,129 B2 * 3/2003 Osawa ..... 211/184
6,726,077 B2 * 4/2004 Roberts et al. ..... 225/103
6,773,081 B2 * 8/2004 Yuyama et al. ..... 312/321
6,932,235 B2 * 8/2005 Abe et al. ..... 221/206
7,055,718 B2 * 6/2006 Jensen ..... 221/310

FOREIGN PATENT DOCUMENTS

WO 01/76708 10/2001

* cited by examiner

LOTTERY TICKET DISPENSER AND TICKET BIN

BACKGROUND OF THE INVENTION

This invention relates generally to article dispensing systems and more particularly to an improved system and method for dispensing lottery tickets.

State sponsored lotteries are now a popular and accepted method of generating revenue and providing entertainment. One popular form of lottery uses an instant lottery ticket on which winning or non-winning combinations are pre-printed before distribution and the player knows immediately after purchasing the ticket whether or not it is a winning ticket. A common system for distributing these and other types of lottery tickets utilizes ticket dispensing machines located at drug stores, supermarkets, convenience stores and the like. Common concerns associated with such lottery ticket dispensing machines are the speed with which they dispense the tickets, the security or anti-theft characteristics of the dispenser and the ability to accurately and consistently dispense the appropriate number of tickets sold from each machine.

Due to the popularity of the instant lottery ticket games and the advantage of minimizing clerical involvement with the purchasing and dispensing of instant lottery tickets, commonly a large number of tickets are stored within the dispensing machine. Presently, tickets are commonly stored in a fanfold form in stacks so that they may be rapidly fed out from a storage compartment without the risk of unintentionally dispensing too many tickets as is common when individual tickets are stored and dispensed from the machine. However, the fanfold tickets must be separated by the machine prior to being dispensed. The mechanism to separate the fanfold tickets from one another should ensure that the separation of the tickets occurs only at the joinder line between the tickets despite whatever variations in the size of tickets and slippage or inaccuracy in the dispensing mechanism may be present.

A problem associated with the dispensing of lottery tickets stored in a fanfold stream is how to ensure that each ticket as it becomes the leading ticket will be separated from the next following ticket precisely along the joinder line between the tickets. In such a fanfold stream, a line of weakness such as a perforation line is provided to define each ticket and to permit fanfolding of the stream of connected tickets. Commonly, each fold in the ticket stack contains a single ticket but in alternative embodiments, a number of tickets for example five or more may be provided within each fold. Lottery tickets conventionally are constructed from laminated layers of paper or cardboard and as such are relatively stiff and inflexible.

The perforations or lines of weakness between the individual tickets are not uniformly formed such that a greater force may be required to separate one line of weakness than another line of weakness in the same fanfold stream. Tickets are manufactured with varying degrees of perforation quality. Some have tough perforations while some perforations are easily separated. Perforation quality varies greatly due to a number of variables including, the ticket printing company, ticket stock, ticket coatings and the like. Aside from these variables, perforation quality can still vary within the same ticket stack. The consistency of ticket perforations vary not only from company to company but also from game to game provided by the same manufacturer.

Successful prior art solutions to the problems of consistently and reliably separating the tickets are disclosed in U.S. Pat. Nos. 4,982,337 and 5,836,498, each of which are assigned to the assignee of this invention and hereby incorporated by reference.

Lottery ticket dispensing machines are commonly located at the point of sale or a checkout counter at the retail establishment to stimulate impulse ticket sales and convenient access to the ticket dispenser by the store clerk. In many ticket dispensers, a clear or transparent window is provided to view the tickets in the dispenser available for purchase. Providing such visible access to the potential purchaser increases ticket sales and revenue. However, due to the variety of sizes and configurations of lottery tickets and the associated fanfold stacks sold and dispensed from the machines, lottery ticket vendors have found it difficult to conveniently position each stack of lottery tickets in the dispenser for optimum visibility and viewing. Preferably, each stack of tickets should be positioned adjacent to the transparent front of the ticket dispensing machine for easy viewing and optimum exposure in the machine.

One prior art solution to the apparent conflicting objectives of providing maximum visual exposure to variously sized tickets and reliable and consistent processing and separating of the tickets during dispensing is to position a roller relative to the ticket storage compartment. The fanfold ticket strip is trained around the roller as the tickets are pulled from the stack and advanced toward the separating mechanism and dispensing slot of the machine. Commonly, the roller is positioned adjacent the front of the dispensing machine in an effort to ensure exposure and visibility of the tickets as they pass over the roller. However, because of the tortuous path the tickets must traverse from the storage compartment and around the roller to the dispensing slot, frequently the perforated joint between the adjacent tickets is weakened, damaged or prematurely burst. This presents significant problems with accurately, consistently and reliably separating the tickets in prior dispensing machines.

Therefore, a need exists for a dispensing machine particularly for lottery tickets which provides for optimum visibility of variously sized tickets stored in the machine and preferably adjacent a front transparent panel of the machine while still maintaining the integrity of the perforated joint joining adjacent tickets together to achieve a consistent and reliable separation of the tickets during the dispensing process.

SUMMARY OF THE INVENTION

These and other shortcomings of prior lottery ticket dispensers have been overcome by this invention. In one embodiment, a lottery ticket dispenser according to this invention includes a number of ticket bins mounted in a housing of the dispenser. The ticket bins hold the fanfold stack of tickets proximate a transparent front panel for optimum visibility. The tickets are fed from each bin by a powered transport mechanism for feeding the lottery tickets along a dispensing path, through a powered separator mechanism and to a dispensing slot in the housing.

The ticket bins are adjustably mounted in a series of vertically arranged drawers in one embodiment of a ticket dispenser according to this invention. Each drawer includes multiple ticket bins for the display and merchandising of multiple lottery tickets. Each drawer is movable to and between an extended position providing convenient access for loading tickets in the bins and a retracted position in which the drawer is contained in the housing for display and dispensing of the tickets.

Advantageously, the ticket bins are adjustably mounted to the associated drawer for proper positioning of a stack of fanfold tickets adjacent to the transparent front panel to provide optimum viewing of the tickets in the housing. In one embodiment, the ticket bin includes a pair of downwardly projecting hooks or tabs which engage a series of sockets in each drawer. The ticket bin therefore can be appropriately be positioned in one of a variety of positions on the drawer depending upon the size and configuration of the stack of fanfold tickets. As such, the tickets can be positioned adjacent the front transparent window regardless of the stack size or configuration by repositioning of the ticket bin on the drawer. The tabs which releasably secure the ticket bins to the drawers are strategically sized, positioned and configured to avoid interference with the adjacent ticket bins and transport of those tickets in the same drawer and superjacent or subjacent drawers.

Unlike prior art dispensers, the tickets are not trained around a roller or exposed to a tortuous path which damages the perforated joints between the adjacent tickets. Each ticket bin includes a pair of spaced flanges projecting upwardly from a bottom of the ticket bin to laterally align the ticket stack in the bin. Each ticket bin also includes an upwardly projecting bulk head along a back edge of the bin to inhibit the ticket stack from moving off of the ticket bin during dispensing of the tickets. In a particular embodiment, the bulk head includes an angular wall connected to an arcuate guide or ticket deflector to assist in pulling the tickets at a proper angle off of the stack to avoid breaking the perforated joints or damaging the tickets. The tickets are transported from the ticket stack upwardly over the arcuate guide by a ticket transport mechanism for processing by a powered separator to separate or burst the adjacent tickets apart prior to dispensing through the slot in the housing. Advantageously, excessive stress is not placed on the tickets which in prior art dispensers resulted in prematurely damaging the tickets, partially or completely bursting the perforated joints or the like.

As a result of the various features of the invention, an improved lottery ticket dispenser provides a more reliable and consistent separation of lottery tickets while offering optimal visibility in the machine for a wide range of ticket sizes and ticket stack configurations.

BRIEF DESCRIPTION OF THE DRAWINGS

The objective and features of the invention are readily apparent from the following detailed description taken in conjunction with the accompanying drawings in which.

DETAILED DESCRIPTION OF THE INVENTION

Figure 1:
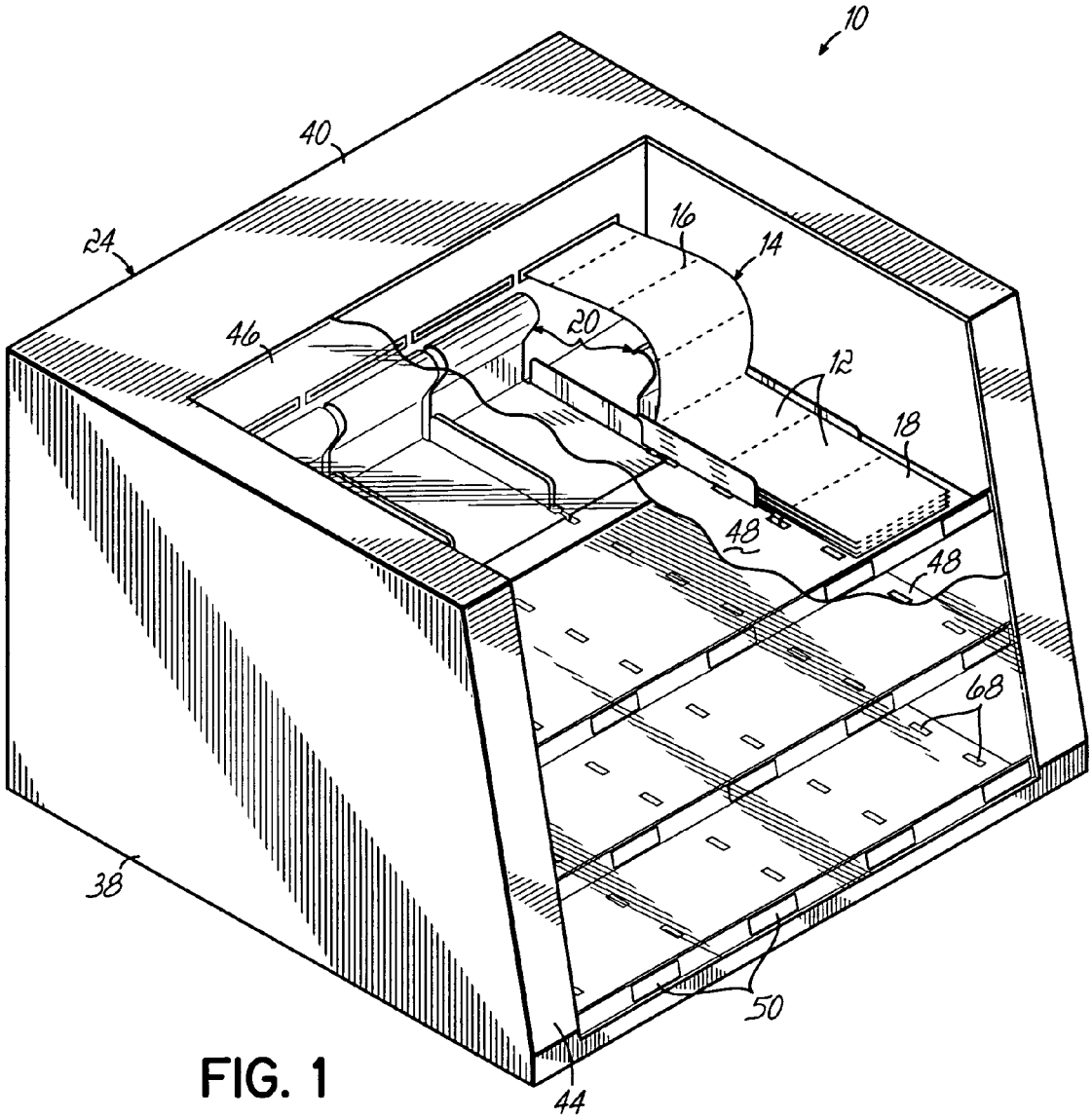
FIG. 1 is a perspective view of one embodiment of a lottery ticket dispenser and ticket bin according to this invention.

A lottery ticket dispenser 10 according to one embodiment of this invention is shown in FIG. 1. A plurality of individual tickets 12 are connected in a fanfold strip or stream 14. Individual tickets 12 are joined to an adjacent ticket by a line of weakness 16 which typically comprises perforations. The tickets 12 are provided typically by the state authority in a fanfold stack 18 which is compact and easily transportable and typically includes as many as 1,500 tickets in each stack. Each ticket 12 is connected to an adjacent ticket 12 along the line of weakness 16 and it will be understood that each successive following ticket 12 is joined to an adjacent ticket by a similar line of weakness 16.

Each stack 18 of fanfold tickets 12 are contained in a storage compartment or bin 20 in the lottery ticket dispenser 10. The fanfold stream 14 of tickets 12 is fed along a dispensing path from the ticket bin 20 toward an outlet or dispensing slot 22 in a housing 24 of the dispenser 10. The ticket strip 14 is transported along the dispensing path by a powered transport mechanism 26 including upper feed roller 28 shown in FIG. 3, and opposed lower feed roller 30. The transport mechanism is powered by a motor 32 to advance or pull the fanfold strip 14 of tickets 12 from respective ticket bin 20 through the rollers 28, 30 to a powered separating mechanism 34. The transport mechanism 26 may include discharge rollers (not shown) downstream from the separating mechanism 34 as is well known in the art.

The powered separating mechanism 34 in one embodiment may include a rotationally driven helical bursting blade 36. The blade 36 is rotationally driven by the motor 32 (or a separate motor—not shown) to contact the strip 14 of tickets 12 and separate adjacent tickets 12 along the perforated joint 16. Those of ordinary skill in the art will readily appreciate that a wide variety of powered ticket transport mechanisms and powered separating mechanisms can be employed in the ticket dispenser 10 according to this invention. Examples of such powered transport and separating mechanisms are shown in U.S. Pat. Nos. 4,982,337 and 5,836,498 as well as published U.S. Patent Application Nos. 2002/0166882; 2002/0100785; 2001/0049986; 2001/0048013; 2001/0034263; and 2001/0006181 each of which are assigned to the assignee of this invention and hereby incorporated by reference entirely.

Figure 3:
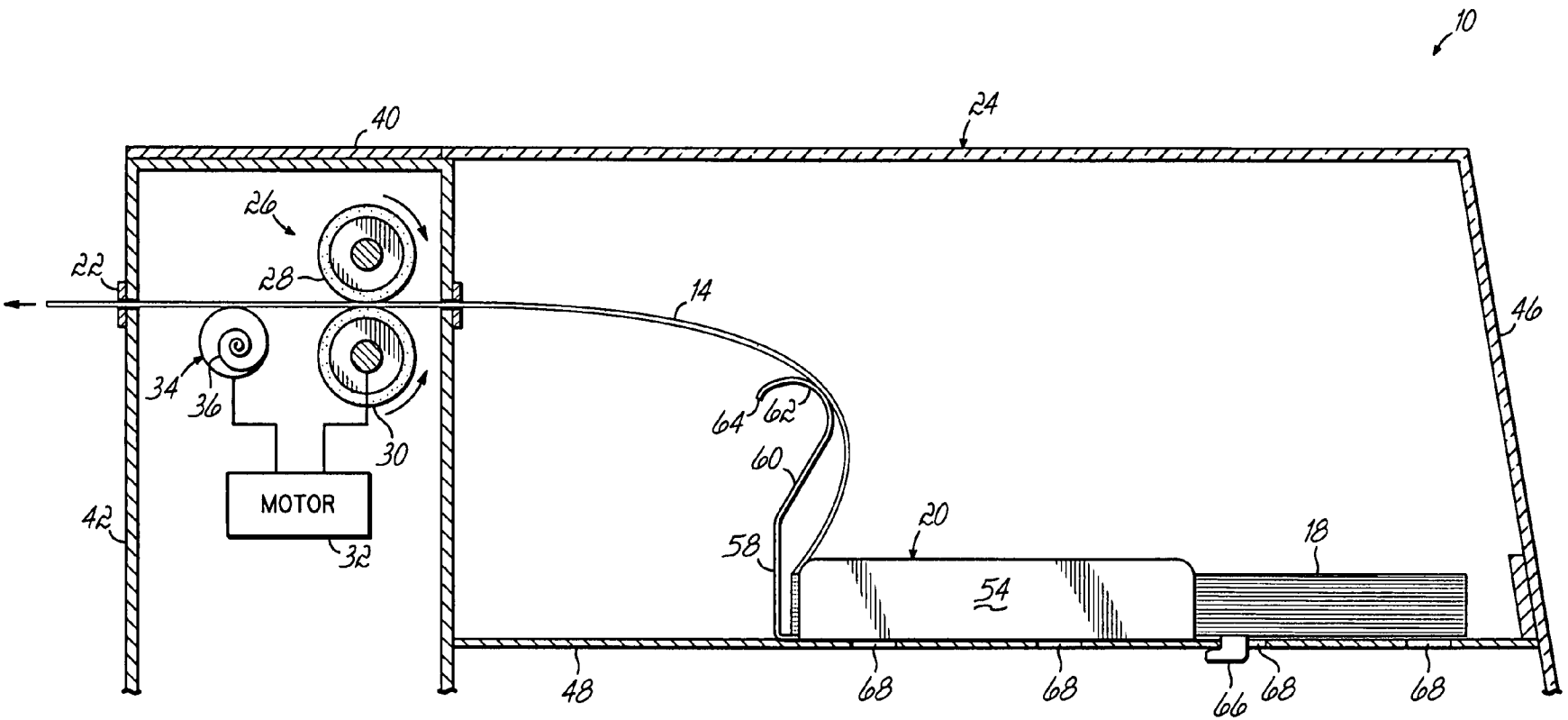
FIG. 3 is a cross-sectional view of lottery tickets being dispensed from the lottery ticket dispenser and ticket bin of FIGS. 1 and 2.

The ticket dispenser housing 24 is shown in FIGS. 1 and 3 and generally includes a pair of spaced sidewalls 38 separated by a top wall 40, bottom wall (not shown), back wall 42 and front wall 44. As shown in FIG. 1, portions of the top wall 40 and front wall 44 according to this embodiment include a generally transparent panel 46 for viewing of the tickets 12 contained in the dispenser 10. Ticket dispensers according to this configuration are marketed by the assignee of this invention under the trademark GAMEGUARD™. Those of ordinary skill in this art will readily appreciate that other configurations and designs for the housing in addition to those shown and described herein are readily compatible with this invention.

Each of the ticket bins 20 are releasably mounted to one of a number of drawers 48 mounted in the housing 24 for movement to and between a retracted position in which the drawer 48 is contained within the housing 24 for dispensing operations as shown in FIG. 1 and an extended position which provides access for the clerk to the ticket bins 20. The tickets 12 are loaded into the separately lockable drawers 48 which can be opened from the back wall 42 of the housing 24. Each drawer 48 may include one or more labels or indicia 50 for identifying the price of the associated tickets as shown in FIG. 1.

Individual ticket bins 20 are releasably mounted to the associated drawer 48 in one of a number of positions depending upon the size and configuration of the lottery tickets 12 and resulting ticket stack 18. Advantageously, the ticket bins 20 can be mounted in the appropriate position for storage of the tickets 12 in the bin 20 closely proximate to the transparent panel 46 and/or front wall 44 of the housing 24. This position provides the best visual access to the tickets 12 through the transparent panel 46.

Figure 2:
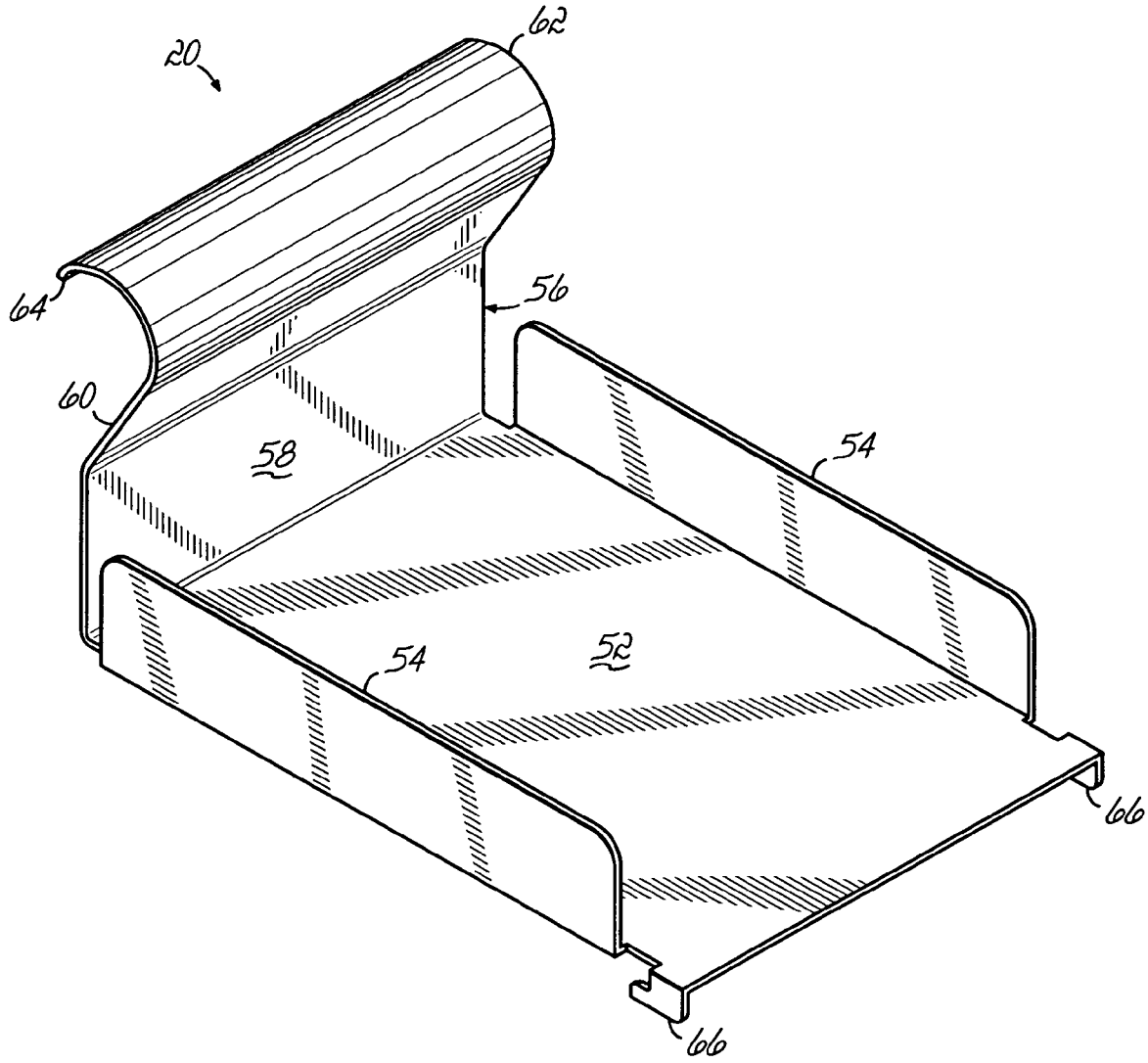
FIG. 2 is a perspective view of one embodiment of the ticket bin according to this invention.

As shown in FIG. 2, one embodiment of the ticket bin 20 according to this invention includes a generally planar bottom 52 having a pair of upwardly projecting generally rectangularly spaced flanges 54 mounted on opposed lateral side edges of the bottom 52. The flanges 54 are sized and configured to contain the ticket stack 18 positioned on the bottom 52 there between. A bulk head 56 projects upwardly from a back edge of the bottom 52 and includes a generally vertical rectangular panel 58 to which is attached an angular wall 60. The angular wall 60 advantageously assists in directing the angle of the tickets 12 as they are being pulled from the stack 18 by the powered transport mechanism 26. An arcuate guide or deflector 62 is formed along the top edge of the angular wall 60. The tickets 12 traverse over the arcuate guide 62 as they are being pulled from the ticket stack 18. The ticket bin 20 configuration according to this invention advantageously avoids breaking of the perforated joints 16, damaging the tickets 12 or otherwise interrupting the dispensing process unlike rollers and other mechanisms utilized in prior art lottery ticket dispensers. In one embodiment, the arcuate guide 62 has a radius of curvature of approximately 0.5 inches and the angle of the angular wall relative to the vertical panel 58 is approximately 35°. The ticket bin is about 4.25 inches wide and the vertical panel and angular wall are about 1.5 inches and 1.25 inches in height, respectively. A generally planar lip 64 may be provided at the terminal edge of the arcuate guide 62 as shown in FIG. 3.

A pair of downwardly depending tabs or hooks 66 are provided at the front corners of the bottom 52 of the ticket bin 20. The tabs 66 are designed and configured for engaging each pair of a series of sockets 68 formed in each drawer 48. In one embodiment, the bottom 52 of the ticket bin is approximately six inches in length; however, the ticket stack 18 may be any dimension and could abut against the vertical panel 58 on one end and overhang the ticket bin 20 on the opposite end. Nevertheless, the ticket bin 20 is positioned in the appropriately selected sockets 68 for juxtaposing the front edge of the ticket stack 18 to the front wall 44 and/or transparent panel 46 of the housing 24 as shown in FIG. 1. Ticket stacks of a different size would require repositioning of the ticket bin 20 in the appropriate sockets 68 in the drawer 48.

As a result of this invention, the ticket stack 18 is consistently positioned for maximum visual exposure adjacent the front wall 44 of the housing 24 while still avoiding stress on the perforation joint 16 and ticket damage during the dispensing process. This invention provides the advantages of keeping the ticket stacks 18 at the front of the ticket dispenser housing 24, avoiding premature bending of the perforated joint and damage to the tickets. Additionally, minimal vertical space is required for the ticket bin 20 and dispensing operation thereby allowing for a more compact ticket dispenser housing while still accommodating a variety of lengths of ticket stacks.

From the above disclosure of the general principles of the present invention and the preceding detailed description of preferred embodiments, those skilled in the art will readily comprehend the various modifications to which this invention is susceptible. Therefore, we desire to be limited only by the scope of the following claims and equivalents thereof.

We claim:

1. A lottery ticket dispenser for dispensing lottery tickets serially connected to each other along perforated joints, the dispenser comprising:

a housing;

at least one drawer mounted within the housing;

at least one slot in the housing through which the tickets are dispensed; and at least one ticket bin adjustably mounted to each drawer, each ticket bin being adapted to contain at least one stack of the lottery tickets in a fan fold configuration, the ticket bin being configured to accommodate a variety of different ticket stacks sizes by being selectively mounted to the associated drawer in one of a plurality of positions disposed generally parallel with a ticket dispensing path.

2. The dispenser of claim 1 further comprising a plurality of drawers vertically arranged in the housing.

3. The dispenser of claim 2 further comprising a plurality of ticket bins horizontally arranged on each drawer.

4. The dispenser of claim 1 wherein the housing further comprises a generally transparent panel through which the tickets in the dispenser are visible.

5. The dispenser of claim 4 wherein the transparent panel is positioned at a front of the housing and the ticket bin is mounted to the drawer in one of the plurality of positions to position the ticket stack proximate the front of the housing and the transparent panel.

6. The dispenser of claim 1 wherein the ticket bin further comprises: an upwardly projecting bulkhead to inhibit the ticket stack from moving off of the ticket bin during dispensing of the tickets.

7. The dispenser of claim 6 wherein the ticket bin further comprises: a generally planar bottom adapted to support the ticket stack; and a pair of spaced flanges each projecting upwardly from an edge of the bottom and adapted to contain the ticket stack positioned there between;

wherein the bulkhead is positioned along a back edge of the bottom.

8. The dispenser of claim 6 wherein the bulkhead further comprises: an angular wall; and an arcuate guide connected to the angular wall adapted to guide the tickets from the stack to the slot for dispensing.

9. The dispenser of claim 1 further comprising:

a powered separator adapted to contact the tickets and separate adjacent tickets at the associated perforated joint.

10. The dispenser of claim 9 further comprising:

a powered ticket transport mechanism adapted to transport the tickets from the ticket bin toward the powered separator and to the slot for dispensing from the dispenser.

11. The dispenser of claim 1 further comprising:

a plurality of sockets in the drawer, each socket corresponding to one of the positions on the drawer; and at least one tab on the ticket bin, each tab being adapted to engage the sockets to releasably mount the ticket bin to the drawer in one of the positions.

12. The dispenser of claim 1 wherein each drawer is movably mounted in the housing for movement to and between and extended position for access to the ticket bin on the drawer and a retracted position in which the drawer is contained within the housing.

13. A lottery ticket dispenser for dispensing a plurality of stacks of lottery tickets serially connected to each other along perforated joints, the dispenser comprising:

a housing;

a generally transparent panel in the housing through which the tickets in the dispenser are visible;

a plurality of drawers vertically arranged in the housing;

at least one slot in the housing through which the tickets are dispensed;

a plurality of ticket bins horizontally arranged and adjustably mounted on each drawer, each ticket bin being adapted to contain at least one stack of the lottery tickets in a fan fold configuration, the ticket bin being configured to accommodate a variety of different ticket stacks sizes by being selectively mounted to the associated drawer in one of a plurality of positions disposed generally parallel with a ticket dispensing path;

wherein the transparent panel is positioned at a front of the housing and the ticket bins are each mounted to the associated drawer in one of the plurality of positions to position the respective ticket stack proximate the front of the housing and the transparent panel;

a powered separator adapted to contact the tickets and separate adjacent tickets at the associated perforated joint; and a powered ticket transport mechanism adapted to transport the tickets from the associated ticket bin toward the powered separator and to the slot for dispensing from the dispenser.

14. The dispenser of claim 13 wherein each ticket bin further comprises: an upwardly projecting bulkhead configured to inhibit the ticket stack from moving off of the ticket bin during dispensing of the tickets.

15. The dispenser of claim 14 wherein each ticket bin further comprises: a generally planar bottom adapted to support the ticket stack; and a pair of spaced flanges each projecting upwardly from an edge of the bottom and adapted to contain the ticket stack positioned there between;

wherein the bulkhead is positioned along a back edge of the bottom.

16. The dispenser of claim 14 wherein the bulkhead further comprises:

an angular wall; and an arcuate guide connected to the angular wall adapted to guide the tickets from the stack to the slot for dispensing.

17. The dispenser of claim 13 further comprising:

a plurality of sockets in each drawer, each socket corresponding to one of the positions on the associated drawer; and at least one tab on each ticket bin, each tab being adapted to engage the sockets to releasably mount the ticket bin to the drawer in one of the positions.

18. The dispenser of claim 13 wherein each drawer is movably mounted in the housing for movement to and between and extended position for access to the ticket bins on the drawer and a retracted position in which the drawer is contained within the housing.

19. A lottery ticket dispenser for dispensing lottery tickets serially connected to each other along perforated joints, the dispenser comprising: a housing;

a plurality of drawers vertically arranged in the housing;

at least one slot in the housing through which the tickets are dispensed;

a plurality of ticket bins horizontally arranged and adjustably mounted on each drawer, each ticket bin being adapted to contain at least one stack of the lottery tickets in a fan fold configuration, the ticket bin being configured to accommodate a variety of different ticket stacks sizes by being selectively mounted to the associated drawer in one of a plurality of positions disposed generally parallel with a ticket dispensing path;

a powered separator adapted to contact the tickets and separate adjacent tickets at the associated perforated joint; and a powered ticket transport mechanism adapted to transport the tickets from the ticket bin toward the powered separator and to the slot for dispensing from the dispenser.

20. The dispenser of claim 19 wherein each ticket bin further comprises: an upwardly projecting bulkhead configured to inhibit the ticket stack from moving off of the ticket bin during dispensing of the tickets.

21. The dispenser of claim 20 wherein each ticket bin further comprises: a generally planar bottom adapted to support the ticket stack; and a pair of spaced flanges each projecting upwardly from an edge of the bottom and adapted to contain the ticket stack positioned there between;

wherein the bulkhead is positioned along a back edge of the bottom.

22. The dispenser of claim 20 wherein the bulkhead further comprises:

an angular wall; and an arcuate guide connected to the angular wall adapted to guide the tickets from the stack to the slot for dispensing.

23. The dispenser of claim 19 further comprising:

a plurality of sockets in each drawer, each socket corresponding to one of the positions on the associated drawer; and at least one tab on each ticket bin, each tab being adapted to engage the sockets to releasably mount the ticket bin to the associated drawer in one of the positions.

24. The dispenser of claim 19 wherein each drawer is movably mounted in the housing in a configuration that accommodates movement to and between and extended position configured to provide access to the ticket bin on the drawer and a retracted position in which the drawer is contained within the housing.

25. The dispenser of claim 8 wherein, when the ticket bin is selectively mounted in different ones of the plurality of positions, the arcuate guide is configured to be at different respective distances from the at least one slot.

26. The dispenser of claim 16 wherein, when the ticket bins are selectively mounted in different ones of the plurality of positions, the arcuate guide is configured to be at different respective distances from the at least one slot.

27. The dispenser of claim 22, wherein, when the ticket bin is selectively mounted in different ones of the plurality of positions, the arcuate guide is configured to be at different respective distances from the at least one slot.

28. The dispenser of claim 1, wherein the ticket bin is configured so that a book of folded fan-fold tickets lays substantially flat in the ticket bin.

29. The dispenser of claim 13, wherein the ticket bins are configured so that books of folded fan-fold tickets lay substantially flat in the ticket bins.

30. The dispenser of claim 19, wherein the ticket bins are configured so that books of folded fan-fold tickets lay substantially flat in the ticket bins.

31. A lottery ticket dispenser for dispensing lottery tickets serially connected to each other along perforated joints, the dispenser comprising:

a housing;

at least one slot in the housing through which the tickets are dispensed; and at least one ticket bin being configured to contain at least one stack of the lottery tickets in a fan fold configuration;

wherein the ticket bin further comprises an upwardly projecting bulkhead configured to inhibit the ticket stack from moving off of the ticket bin during dispensing of the tickets, the bulkhead configured to accommodate a variety of different ticket stacks sizes by being selectively mounted in one of a plurality of positions disposed generally parallel with a ticket dispensing path;

wherein the bulkhead further comprises an angular wall and an arcuate guide connected to the angular wall and adapted to guide the tickets from the stack to the slot for dispensing.

32. The dispenser of claim 31, further comprising:

a plurality of drawers vertically arranged in the housing.

33. The dispenser of claim 31 further comprising:

a generally transparent panel in the housing through which the tickets in the dispenser are visible.

34. The dispenser of claim 31 further comprising:

a powered separator adapted to contact the tickets and separate adjacent tickets at the associated perforated joint; and a powered ticket transport mechanism adapted to transport the tickets from the ticket bin toward the powered separator and to the slot for dispensing from the dispenser.

35. The dispenser of claim 34, further comprising:

a plurality of drawers vertically arranged in the housing, the drawers configured to contain at least one ticket bin; and a generally transparent panel in the housing through which the tickets in the dispenser are visible;

wherein the transparent panel is positioned at a front of the housing and each ticket bin is mounted to the associated drawer to position the respective ticket stack proximate the front of the housing and the transparent panel.

* * * * *